US012546561B2

(12) United States Patent
Lotterman et al.

(10) Patent No.: US 12,546,561 B2
(45) Date of Patent: Feb. 10, 2026

(54) ADJUSTABLE COMB RISER FOR FIREARM AND NON-FIREARM STOCK AND ASSOCIATED METHODS

(71) Applicants: Oliver Lotterman, Bozeman, MT (US); Bradley Penza, Bozeman, MT (US)

(72) Inventors: Oliver Lotterman, Bozeman, MT (US); Bradley Penza, Bozeman, MT (US)

( * ) Notice: Subject to any disclaimer, the term of this patent is extended or adjusted under 35 U.S.C. 154(b) by 3 days.

(21) Appl. No.: 18/511,598

(22) Filed: Nov. 16, 2023

(65) Prior Publication Data

US 2024/0295380 A1 Sep. 5, 2024

Related U.S. Application Data

(60) Provisional application No. 63/383,946, filed on Nov. 16, 2022.

(51) Int. Cl.
*F41C 23/14* (2006.01)
*F41C 23/08* (2006.01)

(52) U.S. Cl.
CPC ..... *F41C 23/14* (2013.01); *F41C 23/08* (2013.01)

(58) Field of Classification Search
CPC ..... F41C 23/14; F41C 23/20
See application file for complete search history.

(56) References Cited

U.S. PATENT DOCUMENTS

2018/0335273 A1* 11/2018 Doty ..... F41C 23/14
2019/0301831 A1* 10/2019 Inneci ..... F41C 23/14

* cited by examiner

*Primary Examiner* — J. Woodrow Eldred
(74) *Attorney, Agent, or Firm* — Collaborative IP; Paul Ditmyer

(57) ABSTRACT

An adjustable comb riser has an elongated stock profile that protrudes above the factory firearm or non-firearm stock, a rear face that clamps between the factory stock backplate and factory recoil pad, using the recoil pad screw holes in the stock backplate without modification. The rear face includes slots that will allow the riser to adjust vertically up and down in order to give the shooter a proper cheek rest on the firearm or non-firearm.

18 Claims, 2 Drawing Sheets

ADJUSTABLE COMB RISER FOR FIREARM AND NON-FIREARM STOCK AND ASSOCIATED METHODS

CROSS-REFERENCE TO RELATED APPLICATIONS

This patent application claims the benefit of U.S. Provisional Patent Application No. 63/383,946, titled "ADJUSTABLE COMB RISER FOR FIREARM AND NON-FIREARM STOCK AND ASSOCIATED METHODS" filed on Nov. 16, 2022, which is herein incorporated by reference in its entirety.

FIELD OF THE INVENTION

The present invention relates in general to rifle stock comb riser, and more particularly to rifle stock comb riser attached/retrofit to the rifle to aid eye alignment with optical or electrical sights.

BACKGROUND

The adjustable comb riser (or cheek rest) is a device that extends the firearm or non-firearm stock comb to adjust the user's eye position to aid in comfortable, consistent alignment with their sight or scope. A cheek rest may allow users of differing sizes to adapt the comb height to fit sights mounted at various heights. The majority of firearm and non-firearm stocks were designed for the use of iron sights that sit much lower relative to the stock comb than modern large diameter magnified or electronic optical sights.

There are many current examples of these risers however they require permanent modification of the factory stock or complete replacement of the factory stock or are wrapped around the stock but not axially fixed. Many of these examples also require the use of additional fasteners solely for riser operation.

Various patent documents illustrate the prior art cheek risers including U.S. Pat. Nos. 10,458,746B2, 8,720,099B1, 5,970,642A, 4,122,623A, 4,896,446A, 10,302,387B2, US20210048274A1, DE202020000469U1, U.S. Pat. Nos. 5,970,642A, 8,720,099B1, 4,122,623A, 9,726,444B1, and 5,009,021A for example.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

The present invention provides an improved comb riser that gives the user the functionality of an adjustable riser without the need to modify the firearm or non-firearm factory stock and does not require the use of any additional fasteners or separate mechanisms.

An embodiment is directed to an adjustable comb riser for a stock on a firearm and/or non-firearm projectile weapon. The comb riser includes a riser body having an elongated stock profile configured to protrude from a top of the stock. A rear plate is structurally coupled to the riser body and extending transverse thereto, and configured to be mounted between the stock and an associated recoil pad using stock fasteners. A plurality of adjustment slots are positioned in the rear plate and configured to receive the stock fasteners therethrough to adjustably mount the comb riser to the stock and provide vertical comb adjustment to selected heights above the stock.

Additionally, and/or alternatively, the plurality of adjustment slots are configured to keep the comb riser in alignment with the stock.

Additionally, and/or alternatively, the riser body and the rear plate are formed as a single-piece integral unit.

Additionally, and/or alternatively, the riser body and rear plate are formed of a polymer, polycarbonate, or aluminum, for example.

Additionally, and/or alternatively, loosening and retightening of the fasteners within the adjustment slots provides for vertical comb adjustment.

Additionally, and/or alternatively, the plurality of adjustment slots comprises two adjustment slots.

Another embodiment is directed to an adjustable comb riser for a stock on a firearm and/or non-firearm projectile weapon. The comb riser includes a riser body having an elongated stock profile configured to protrude from a top of the stock. A rear plate is transversely coupled to the riser body, and configured to be mounted between the stock and an associated recoil pad using stock fasteners. Upper and lower adjustment slots are positioned in the rear plate, configured to receive the stock fasteners therethrough to adjustably mount the comb riser to the stock, provide vertical comb adjustment to selected heights above the stock, and keep the comb riser in alignment with the stock.

Additionally, and/or alternatively, the riser body and the rear plate are formed as a single-piece integral unit.

Additionally, and/or alternatively, the riser body and rear plate are formed of at least one of a polymer, a polycarbonate, and aluminum.

Additionally, and/or alternatively, loosening and retightening of the fasteners within the adjustment slots provides for vertical comb adjustment.

Another embodiment is directed to a method of making an adjustable comb riser for a stock on a firearm and/or non-firearm projectile weapon. The method includes: forming a riser body having an elongated stock profile configured to protrude from a top of the stock; forming a rear plate transversely coupled to the riser body, and configured to be mounted between the stock and an associated recoil pad using stock fasteners; and forming a plurality of adjustment slots in the rear plate and configured to receive the stock fasteners therethrough to adjustably mount the comb riser to the stock and provide vertical comb adjustment to selected heights above the stock.

Additionally, and/or alternatively, the plurality of adjustment slots are configured to keep the comb riser in alignment with the stock.

Additionally, and/or alternatively, the riser body and the rear plate are formed as a single-piece integral unit.

Additionally, and/or alternatively, the riser body and rear plate are formed of at least one of a polymer, polycarbonate, and aluminum.

Additionally, and/or alternatively, loosening and retightening of the fasteners within the adjustment slots provides for vertical comb adjustment.

Additionally, and/or alternatively, the plurality of adjustment slots comprises two adjustment slots.

The comb riser mounts in between the factory stock and factory buttplate (recoil pad) using the factory fasteners to secure the comb riser. The adjustable comb riser utilizes slots and the factory fasteners to stay in alignment with the stock and allow for vertical comb adjustment depending on the user's height requirements and sighting system.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
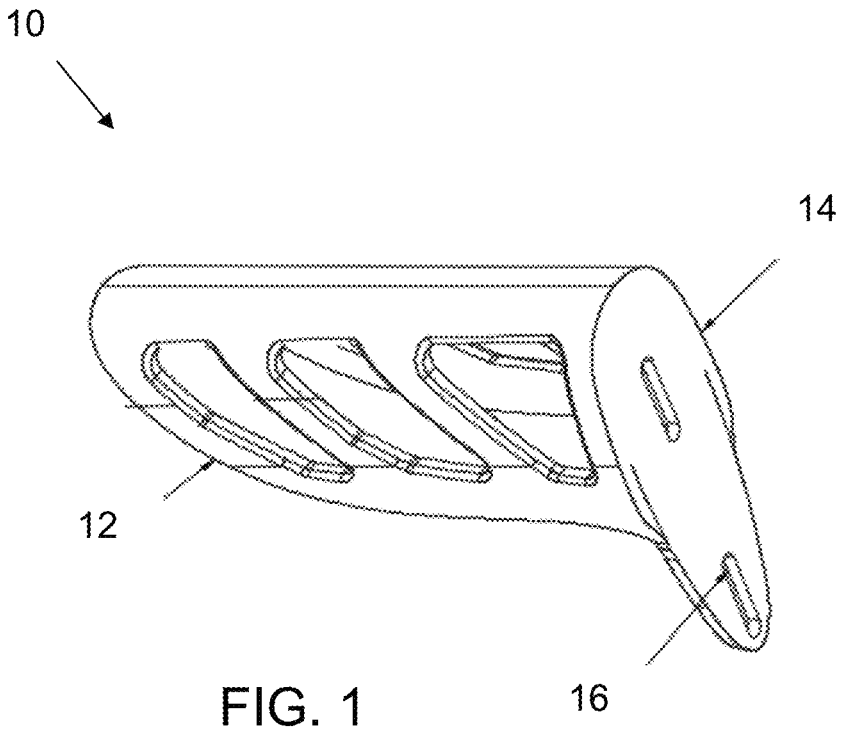
FIG. 1 is a perspective view of an embodiment of the adjustable comb riser according to features of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Before describing the present disclosure in detail, it is to be understood that this disclosure is not limited to parameters of the particularly exemplified systems, methods, apparatus, products, processes, and/or kits, which may, of course, vary. It is also to be understood that the terminology used herein is only for the purpose of describing particular embodiments of the present disclosure, and is not necessarily intended to limit the scope of the disclosure in any particular manner. Thus, while the present disclosure will be described in detail with reference to specific embodiments, features, aspects, configurations, etc., the descriptions are illustrative and are not to be construed as limiting the scope of the claimed invention. Various modifications can be made to the illustrated embodiments, features, aspects, configurations, etc. without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "embodiment," "alternative embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "sensor" includes one, two, or more sensors.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. In addition, similar elements and/or elements having similar functions may be designated by similar numbering (e.g., element "10" and element "210.") Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein.

It is also noted that systems, methods, apparatus, devices, products, processes, compositions, and/or kits, etc., according to certain embodiments of the present invention may include, incorporate, or otherwise comprise properties, features, aspects, steps, components, members, and/or elements described in other embodiments disclosed and/or described herein. Thus, reference to a specific feature, aspect, steps, component, member, element, etc. in relation to one embodiment should not be construed as being limited to applications only within said embodiment. In addition, reference to a specific benefit, advantage, problem, solution, method of use, etc. in relation to one embodiment should not be construed as being limited to applications only within the embodiment.

The headings used herein are for organizational purposes only and are not meant to be used to limit the scope of the description or the claims. To facilitate understanding, like reference numerals have been used, where possible, to designate like elements common to the figures.

An embodiment of the invention, as shown and described by the various figures and accompanying text, provides devices, systems and methods to provide an adjustable comb riser (or cheek rest).

Figure 2:
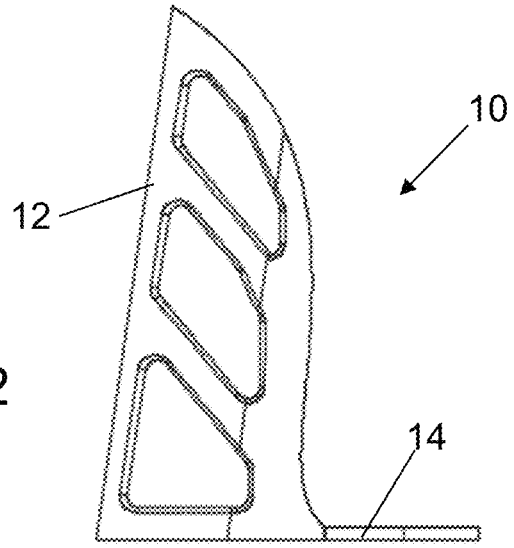
FIG. 2 is a side view of the adjustable comb riser of FIG. 1.
Figure 3:
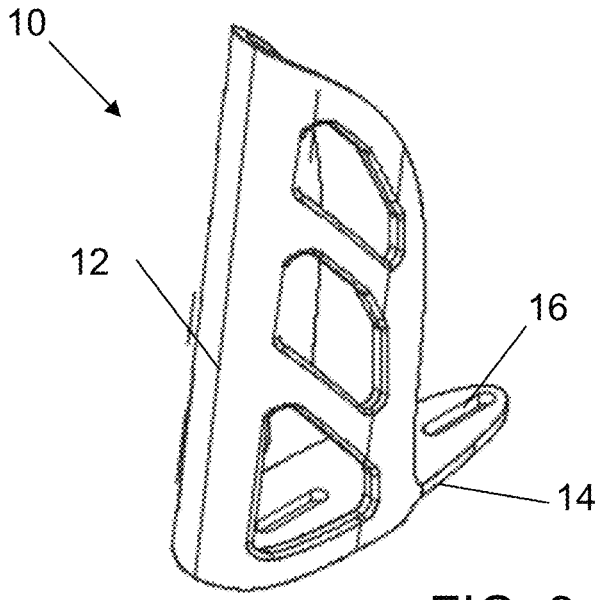
FIG. 3 is another perspective view of the adjustable comb riser of FIG. 1.
Figure 4:
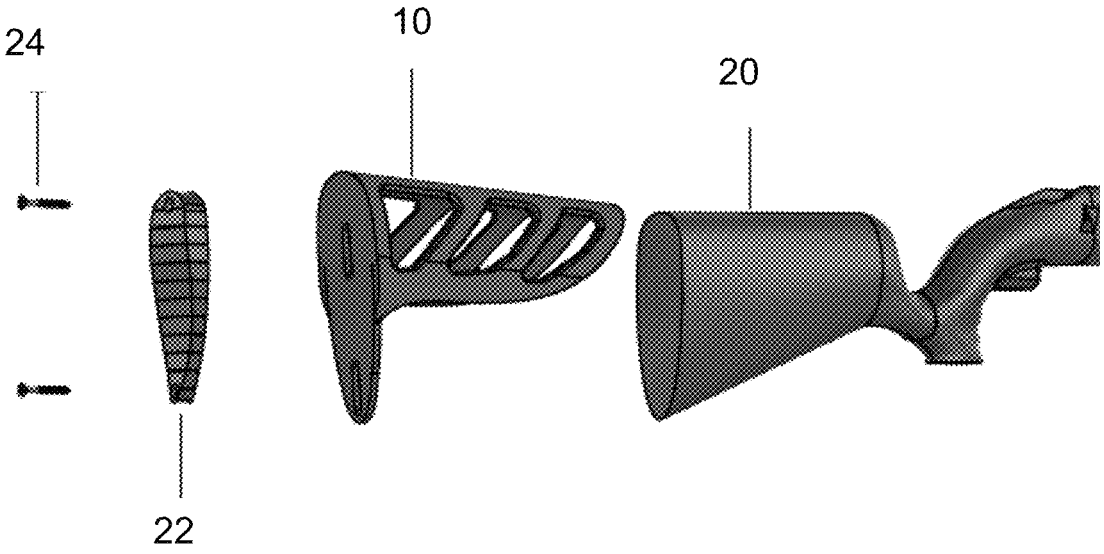
FIG. 4 is an exploded view illustrating the adjustable comb riser of FIG. 1 in relation to a rifle stock.

FIGS. 1-4 illustrate an example embodiment of an adjustable comb riser 10 or cheek rest. FIG. 1 is a perspective view of the adjustable comb riser. FIG. 2 is a side view of the adjustable comb riser 10. FIG. 3 is another perspective view of the adjustable comb riser. FIG. 4 is an exploded view illustrating the adjustable comb riser 10 in relation to a rifle stock 20.

The comb riser 10 can be attached/retrofit to a rifle in between the recoil pad 22 (aka buttplate) and firearm or non-firearm (e.g. crossbow) stock 20 using the existing recoil pad fastener location. Protrusion of the comb riser 10 above the stock comb 20 is adjustable by loosening, sliding the comb riser 10 on the vertical axis, and then retightening the fasteners 24. This allows the user to achieve a tight cheek weld when using optics that are set above the natural line of sight of the original stock comb 20.

The adjustable comb riser 10 includes a riser body 12, a rear plate 14 and adjustment slots 16 to receive the fasteners 24. Loosening the factory fasteners 24 (or recoil pad screws) allows for vertical adjustment of the comb riser 10. Tightening the fasteners 24 clamps the rear plate 14 between the recoil pad 22 and stock 20 (e.g. at the backplate), thereby selectively fixing the vertical comb height.

The adjustable comb riser 10 may be formed as a single-piece integral unit from various materials including, but not limited to, polymers, polycarbonate, and aluminum, for example.

This example makes use of the firearm or non-firearm factory fasteners 24 with no additional modification needed. This ensures functionality without compromising, damaging or modifying the factory stock 20. The riser body 12 has an elongated stock profile that protrudes from the top of the stock 20, and the rear plate 14 may conform to the factory stock profile. The comb riser 10 mounts in between the factory stock 20 and factory recoil pad 22 or buttplate using the factory fasteners 24, or aftermarket fasteners, to secure the comb riser. The adjustable comb riser 10 utilizes the slots 16 and the factory fasteners 24, or aftermarket fasteners, to stay in alignment with the stock 20 and allow for vertical comb adjustment to multiple different sight heights depending on the user's height requirements and sighting system.

A method of making the adjustable comb riser 10 includes: forming a riser body 12 having an elongated stock profile configured to protrude from a top of the stock 20; forming a rear plate 14 transversely coupled to the riser body 12, and configured to be mounted between the stock 20 and an associated recoil pad 22 using stock fasteners 24; and forming a plurality of adjustment slots 16 in the rear plate 14 and configured to receive the stock fasteners 24 therethrough to adjustably mount the comb riser 10 to the stock 20 and provide vertical comb adjustment to selected heights above the stock 20.

The comb riser 10 may be manufactured via additive manufacturing, using molds, or machined, for example.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items.

The invention claimed is:

1. An adjustable comb riser for a stock on a firearm and/or non-firearm projectile weapon, the comb riser comprising:

a riser body having an elongated stock profile configured to protrude from a top of the stock;

a rear plate structurally coupled to the riser body and extending transverse thereto, and configured to be mounted between the stock and an associated recoil pad using stock fasteners; and a plurality of adjustment slots positioned in the rear plate and configured to receive the stock fasteners therethrough to adjustably mount the comb riser to the stock and provide vertical comb adjustment to selected heights above the stock.

2. The adjustable comb riser according to claim 1, wherein the plurality of adjustment slots are configured to keep the comb riser in alignment with the stock.

3. The adjustable comb riser according to claim 1, wherein the riser body and the rear plate are formed as a single-piece integral unit.

4. The adjustable comb riser according to claim 1, wherein the riser body and rear plate are formed of a polymer.

5. The adjustable comb riser according to claim 1, wherein the riser body and rear plate are formed of a polycarbonate.

6. The adjustable comb riser according to claim 1, wherein the riser body and rear plate are formed of aluminum.

7. The adjustable comb riser according to claim 1, wherein loosening and retightening of the fasteners within the adjustment slots provides for vertical comb adjustment.

8. The adjustable comb riser according to claim 1, wherein the plurality of adjustment slots comprises two adjustment slots.

9. An adjustable comb riser for a stock on a firearm and/or non-firearm projectile weapon, the comb riser comprising:

a riser body having an elongated stock profile configured to protrude from a top of the stock;

a rear plate transversely coupled to the riser body, and configured to be mounted between the stock and an associated recoil pad using stock fasteners; and upper and lower adjustment slots positioned in the rear plate, configured to receive the stock fasteners therethrough to adjustably mount the comb riser to the stock, provide vertical comb adjustment to selected heights above the stock, and keep the comb riser in alignment with the stock.

10. The adjustable comb riser according to claim 9, wherein the riser body and the rear plate are formed as a single-piece integral unit.

11. The adjustable comb riser according to claim 9, wherein the riser body and rear plate are formed of at least one of a polymer, a polycarbonate, and aluminum.

12. The adjustable comb riser according to claim 9, wherein loosening and retightening of the fasteners within the adjustment slots provides for vertical comb adjustment.

13. A method of making an adjustable comb riser for a stock on a firearm and/or non-firearm projectile weapon, the method comprising:

forming a riser body having an elongated stock profile configured to protrude from a top of the stock;

forming a rear plate transversely coupled to the riser body, and configured to be mounted between the stock and an associated recoil pad using stock fasteners; and forming a plurality of adjustment slots in the rear plate and configured to receive the stock fasteners therethrough to adjustably mount the comb riser to the stock and provide vertical comb adjustment to selected heights above the stock.

14. The method according to claim 13, wherein the plurality of adjustment slots are configured to keep the comb riser in alignment with the stock.

15. The method according to claim 13, wherein the riser body and the rear plate are formed as a single-piece integral unit.

16. The method according to claim 13, wherein the riser body and rear plate are formed of at least one of a polymer, polycarbonate, and aluminum.

17. The method according to claim 13, wherein loosening and retightening of the fasteners within the adjustment slots provides for vertical comb adjustment.

18. The method according to claim 1, wherein the plurality of adjustment slots comprises two adjustment slots.

* * * * *